United States Patent [19]

Hecht

[11] 4,133,849

[45] Jan. 9, 1979

[54] CARBURETOR ATOMIZER

[76] Inventor: Victor Hecht, 969 Alexander Dr., Haysville, Kans. 67060

[21] Appl. No.: 522,502

[22] Filed: Nov. 11, 1974

[51] Int. Cl.[2] ..... F02M 7/02

[52] U.S. Cl. ..... 261/78 R; 261/DIG. 39

[58] Field of Search ..... 261/78 R, DIG. 39, 41 D, 261/121 A

[56] References Cited

U.S. PATENT DOCUMENTS

| | | | |
|---|---|---|---|
| 2,092,015 | 9/1937 | Pierce | 261/DIG. 39 |
| 2,714,503 | 8/1955 | Heisler | 261/78 R |
| 3,223,394 | 12/1965 | Walsh | 261/78 R |
| 3,387,830 | 6/1968 | McIlroy | 261/121 A |
| 3,472,495 | 10/1969 | Marsee | 261/DIG. 39 |
| 3,873,650 | 3/1975 | Jamkin | 261/DIG. 39 |

FOREIGN PATENT DOCUMENTS

| | | | |
|---|---|---|---|
| 809993 | 3/1959 | United Kingdom | 261/78 R |
| 881461 | 11/1961 | United Kingdom | 261/78 R |

*Primary Examiner*—Ronald H. Lazarus

*Attorney, Agent, or Firm*—John H. Widdowson

[57] ABSTRACT

A carburetor having an atomizer mounted in a carburetor body with an atomizer tube extending into a center portion of the fuel and air mixing conduit. The atomizer tube is communicably connected with a fuel reservoir on one end and has an enlarged outlet end portion on its opposite end. The outlet end portion is flared on its exterior and has the outlet end surface thereof transverse to the fuel-air mixing conduit with the outlet thereof opening toward the outlet of the fuel-air mixing conduit.

1 Claim, 3 Drawing Figures

CARBURETOR ATOMIZER

BACKGROUND OF THE INVENTION

This invention is related to carburetors, and more specifically to fuel atomizers for carburetors. This invention relates to an atomizing device for use in carburetors which are used on internal combustion engines to obtain a substantially completely atomized fuel-air mixture for increased using efficiency and performance.

Numerous types of carburetors and atomizer devices for carburetors are known in the prior art for atomizing fuel in an air stream through a carburetor. Many of these atomizing devices have a considerable number of small and intricately formed parts which makes them complicated and expensive to manufacture in any significant quantity and with any acceptable quality. The atomizers known in the prior art have ring like structures circular members constructed with a plurality of small openings in an attempt to disperse the fuel to a divided state before it is introduced to the airflow. Some prior art atomizing devices merely direct a stream of fuel onto a plate member or the like which sprays the fuel into the air stream. Still other atomizing devices use screens and finely divided perforate members to separate or break up the fuel in the airstream. While all of these devices do function to atomize fuel in an airstream they generally produce large droplets of fuel, or in other words, they only roughly divide the liquid fuel stream in the throat of a carburetor.

SUMMARY OF THE INVENTION

In a preferred specific embodiment a carburetor atomizer structure includes an atomizer tube mountable in the body of a carburetor with the atomizer tube having its outlet in a center portion of an air-fuel mixture conduit in the carburetor. The atomizer tube has an enlarged outlet end portion with the outlet end surface thereof extending transverse to the fuel-air mixture conduit of the carburetor and the outlet of the atomizer tube open toward the outlet of the fuel-air mixture conduit. The outlet end portion of the atomizer tube is in proximity to a venturi portion of the fuel-air mixture conduit of the carburetor.

One object of this invention is to provide a carburetor and a carburetor atomizer overcoming the aforementioned disadvantages of the prior art devices.

Still, one other object of this invention is to provide a carburetor structure for supplying a fuel-air mixture having a carburetor body with a venturi type fuel-air mixture conduit therethrough, a throttle valve in the conduit, a fuel reservoir within the carburetor body and a fuel atomizer mounted in the body having an atomizer tube extending into a center portion of the fuel-air mixture conduit. The fuel atomizer tube has an enlarged flared outlet end portion with the outlet opening toward the outlet of the fuel-air mixture conduit.

Still, another object of this invention is to provide a carburetor atomizer mountable in a carburetor having a fuel-air mixture conduit with a venturi portion. The atomizer is constructed with a tube having an enlarged outlet end portion positionable in the center portion of the conduit in a lower pressure zone of the venturi and with the atomizer having a flat outlet end surface transverse to the conduit with the outlet thereof open toward the fuel-air mixture conduit outlet.

Still, another object of this invention is to provide a carburetor atomizer having a tube which is mountable in the venturi portion of fuel-air mixture conduit or throat of a carburetor wherein the exterior of the tube is flared in its outlet end portion and the outlet end surface of the tube is substantially flat and transverse to the mixture conduit.

Various other objects, advantages, and features of this invention will become apparent from those skilled in the art from the following discussion, taken in conjunction with the accompanying drawings, in which:

Figure 2:
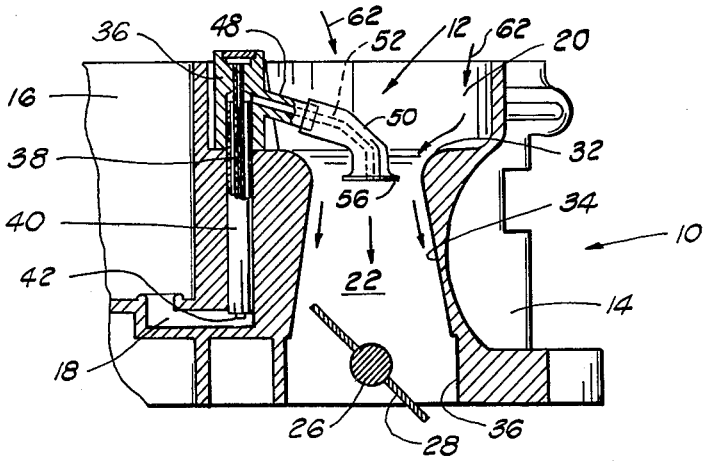
FIG. 2 is a sectional view of the carburetor and the atomizer shown in FIG. 1, with the view taken on line 2—2 of FIG. 1.

The following is a discussion and description of preferred specific embodiments of the carburetor atomizer structure of this invention, such being made with reference to the drawings, whereupon the same reference numerals are used to indicate the same or similar parts and/or structure. It is to be understood that such discussion and description is not to unduly limit the scope of the invention.

DESCRIPTION OF PREFERRED EMBODIMENTS

Figure 1:
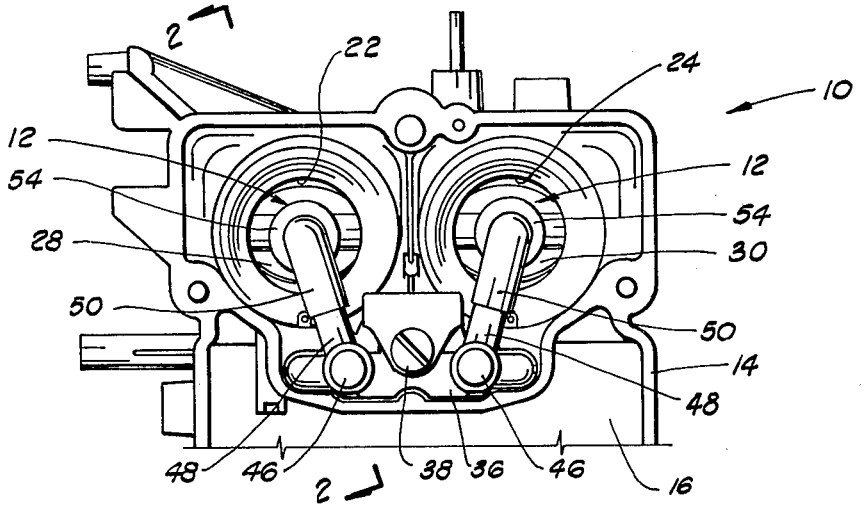
FIG. 1 is a fragmentary top plan view of a carburetor having the carburetor atomizer of this invention installed therein. The carburetor has the upper portion thereof removed for clarity.

Referring to the drawings in detail and in particular to FIG. 1, a carburetor is shown generally at 12 having the fuel atomizer means 12 of this invention mounted therewith. The carburetor 12 is a conventional type commonly used with internal combustion engines such as in automobiles, trucks, and for other applications. The carburetor 10 includes a support base or body 14 having a portion thereof formed as a fuel bowl or reservoir 16 with an outlet conduit 18 therefrom, and a fuel-air mixture conduit through the body 14 with the atomizer means 12 extending thereinto. The reservoir 16 is connected by a fuel line to a fuel tank (not shown) which supplies liquid fuel to the carburetor 10. The reservoir 16 also contains a float valve assembly (not shown) which is used to maintain a predetermined and certain fuel level in the reservoir cavity. The carburetor 10 shown is a dual throat carburetor having a single aperture inlet 20 in the upper portion of the body 14 with the lower portion divided into two fuel-air mixture conduits identified at 22 and 24. A throttle valve assembly is provided in the lower portion of the carburetor body 14 to control the fuel-air mixture flow through each of the fuel-air mixture conduits 22 and 24. The throttle valve assembly has a rotatable shaft 26 mounted through the carburetor body 14 and with a pair of essentially elliptically shaped valve closure members 28 and 30 secured thereto and positioned in the fuel-air mixture conduits, 22 and 24 respectively. In use the shaft 26 is rotated by a throttle control linkage or apparatus (not shown) to open and close the mixture conduits 22 and 24 as desired to regulate the quantity of the air-fuel mixture flowing from the carburetor.

Each of the fuel-air mixture conduits or throats 22 and 24 are circular in transverse cross section and are constructed similarly. Each of the fuel-air mixture conduits of the carburetor 10 have a venturi orifice portion in a mid portion thereof as shown clearly in FIG. 2. The venturi orifice portion of the conduit has a substantially smooth wall surface with the smallest diameter portion of the venturi being in the upper end portion thereof as indicated at 32. From the smallest diameter portion 32 the venturi sidewall tapers outward as indicated at 34 toward the outlet end of the mixture conduit. The outlet end portion 36 of each fuel-air mixture conduit 22 and 24 is circular in transverse cross section and has the throttle valve assembly mounted therethrough with the valve closure members 28 being contactable with the wall thereof. The throttle valve means valve closure members or flapper valves are movable by rotation of the shaft 26 between a closed position and a fully open position.

Figure 3:
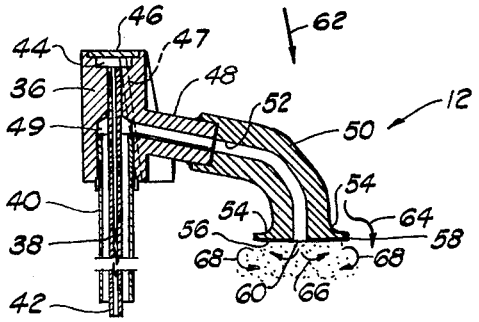
FIG. 3 is a cross sectional view of one side of the carburetor atomizer alone with arrows illustrating the airflow and the resultant fuel-air mixture flow which takes place when the carburetor atomizer is in operation.

The fuel atomizing means 12 is mounted in the inlet portion of the carburetor throats as shown in FIGS. 1 and 2. The atomizer 12 includes a pair of atomizer tubes which extend into each of the fuel-air mixture conduits 22 and 24. The fuel atomizer means has an irregularly shaped base 36 which is rigidly secured by a screw 38 to the carburetor body 14 on top of a flat surface in the body. Each of the two atomizer tubes of the atomizer means 12 are individually connected to the fuel reservoir 16 by feed tubes which are mounted in the carburetor body 14. The feed extend through apertures in the carburetor body 14 to the reservoir outlet conduits 18. FIG. 2 shows one of the atomizer feed tubes in its communicably connected relation with the carburetor 10. FIG. 3 shows one carburetor atomizer including the feed tube alone in cross section. The smaller and longer feed tube 38 is rigidly mounted with the base 36 and enclosed in an outer larger feed tube 40.

Feed tube 38 is commonly referred to as an idle tube because it supplies fuel for the idle circuit of the carburetor 10 which operates independently of the high speed circuit. Feed tube 38 has its inlet 42 below the inlet of the larger feed tube 40. Feed tube 38 is rigidly mounted in the base 36 and it is communicably connected to a cavity 44 in the upper portion of the base 36. The cavity 44 has a plug 46 on its upper end. In manufacture of the base 36 the cavity 44 is initially open thus necessitating the plug. A conduit 47 in base 36 connects the cavity 44 with another idle circuit conduit in the carburetor body 14. It is to be noted that the idle tube or feed tube portion of the carburetor's idle circuit can be constructed separate and apart from the high speed circuit portion of the carburetor if desired. The carburetor that has been used in parctice of this invention is constructed as shown.

The high speed feed tube or atomizer feed tube 40 is rigidly mounted in the base 36 and communicably connected with a cavity 49 at its upper end portion in the base 36. In use fuel flows around the idle tube 38 inside the high speed tube 40 and into the base 36 where it passes into the inlet of the atomizer tube at the base 36.

The atomizer tube has an upper portion indicated at 48 integral with the base 36 and communicably connected with the cavity 49. The atomizer tube has a lower portion 50 attached to the upper portion 50 by welding, soldering or a threaded connection if desired. It is to be noted that if desired the upper portion 50 and lower portion 48 can be constructed as one piece. The atomizer tube is a conduit and it has a smooth walled interior, indicated at 52, through its entire length to provide for a streamlined fluid flow. The atomizer tube has smoothly shaped curvature in the portion thereof which is in the mixture conduit so a substantially streamlined and unobstructed fluid flow can be easily maintained through the atomizer tube to its outlet. The atomizer tube upper end portion 48 extends angularly downward into the mixture conduit and the lower portion 50 includes a smoothly curved portion turning toward the throttle valve and a straight end portion substantially axially disposed in the mixture conduit. The outlet end portion of the atomizer tube is enlarged and it has a flared exterior portion 54 as shown. The atomizer tube portion 50 is preferably solid, as shown, with the flared portion 54 beginning a substantial distance above the outlet end surface thereof. The atomizer tube has a substantially flat outlet end surface 56 on the downwardly disposed outlet end thereof. The flat surface 56 is transverse to the carburetor throat, as shown, so in use it is transverse to the airflow. The perimeter or edge of the outlet end portion is preferably circular and it is indicated at 58. The atomizer tube has its outlet or discharge orifice 60 in the center portion of the essentially circular flat surface 56. The orifice 60 is substantially the same size as the smooth walled conduit interior 52. Because the conduit interior 52 is smooth and provides a substantially streamlined fuel flow the fuel discharge from the orifice is substantially smooth and uniform which aids in atomization or dispersion of the fuel. The atomizer means 12 is constructed so that the flared outlet end portion 54 is positioned with the discharge orifice 60 and the flat surface 56 in a low pressure zone in the venturi portion of the carburetor throats 22 and 24. FIG. 2 shows the outlet end portion of the atomizer tube in such a position. The venturi of the carburetor body 14 functions as does any other venturi wherein the lowest pressure zone thereof is in proximity to the narrowest portion thereof and it is preferred that the discharge orifice 60 be in this low pressure zone. Because both of the atomizer tubes of the atomizer means as shown in the drawings are constructed similarly they are both given identical numerals of identification purposes.

It is to be noted that the fuel atomizer means 12 of this invention can be readily mounted on a conventional carburetor by removing the screw 38 and replacing a standard or conventional fuel atomizer (not shown) with the fuel atomizer means 12 of this invention. Before the fuel atomizer of a carburetor can be removed the air filter which is normally connected with a carburetor, and the air horn or upper portion of the carburetor structure (not shown) must be removed to gain access to the portion of the carburetor where the atomizer is mounted. The specific size and shape of a base 36 is not critical to this invention, and such can be selectively constructed as needed to fit the existing mounting holes and base support structure of a standard or conventional carburetor. Of course, the placement of the discharge orifice 60 and the flat bottom surface 56 of the atomizer tube outlet must necessarily be positioned as described in relation to the venturi portion of the carburetor fuel-air mixture conduit for optimum effectiveness.

In the use and operation of a carburetor having the fuel atomizer means of this invention it shall be assumed that the carburetor 10 in its complete form is mounted with an internal combustion engine and connected to a suitable fuel supply. With the engine operating and the throttle valve means in an open position somewhat as shown in FIG. 1 the intake strokes of the engine create a suction to pull air through the carburetor 10 as indicated by the arrows 62. As the air moves through the venturi portion it is accelerated and the pressure is reduced below atmospheric pressure in a low pressure zone in proximity to the venturi. As this accelerated air passes through the venturi portion of the carburetor it also passes over the outlet end portion of the atomizer tubes. FIG. 3 shows in detail the air flow past the outlet end portion of one atomizer tube. The curved arrow indicated at 64 illustrates the airflow as it moves past the flared portion 54 and over the edge 58. As air moves past the flared portion 54 it is made extremely turbulent by the flared exterior shape of the atomizer outlet end portion in much the same manner as a vortex generator causes air turbulence. Because there is a substantial pressure differential between the fuel reservoir and the atomizer outlet orifice 60 fuel is drawn from the reservoir 16 through conduits 18 and 40 into the atomizer tube and discharged from the outlet 60. Fuel flowing through the atomizer tube and out of the discharge orifice 60 is indicated by the arrow 66. The fuel flow rate is governed by the size of restrictions in the fuel passageway between the fuel reservoir and the discharge orifice and the airflow rate through the carburetor which is controlled by the throttle valve. As the fuel flows from the discharge orifice 60 a portion of it clings to the flat surface 56 and moves outward away from the orifice 60 on the flat surface 56 toward the edge 58. When the fuel departs from the flat surface 56 it is moved by turbulent and circulating air currents in the vicinity of the lower side of the flange portion 54 indicated by the arrows 68. Because of the extremely turbulent air currents caused by the flared portion 54 and the venturi, the fuel is dispersed into a finely divided state. More specifically, when the fuel leaves the flat surface 56 it is substantially completely divided into extremely small droplets and spread through the fluid stream downstream of the atomizer tube's outlet end portion. The flat surface 56 in use functions as a distributor for the fuel or as a wick to carry the fuel in an exposed condition to the airstream. A portion of the fuel which leaves the discharge orifice 60 will of course pass directly into the airstream in the vicinity of the discharge orifice 60. However, in practice, it has been observed that a significant quantity of the fuel leaving the discharge orifice 60 passes over the flat surface 56 and then into the airstream.

The size, shape and exact vertical position of the atomizer tube's outlet end portion are things which must be determined by empirical methods for a particular carburetor. However, it is believed that the size, shape, and vertical position of the atomizer tube's outlet end portion will not vary significantly from that described and shown in the drawing. The atomizer means 12 operates to achieve a substantially complete atomization of the fuel as it leaves the outlet end portion of the atomizer tube. The flange portion 54 in use functions to create extreme turbulence in the space adjacent to the outlet thus providing an ideal medium for producing a homogeneous fuel-air mixture with the carburetor. In practice, the carburetor atomizer of this invention has been successfully used and extensively tested on an automobile having an internal combustion engine of approximately 400 cubic inches (6.56 liters) with the outlet end portion of the atomizer tube being approximately 30% of the smallest diameter of the venturi portion of the carburetor. In such practice, the fuel mileage was greatly increased and the amount of objectionable exhaust gas emissions was substantially reduced. In other words, the atomizer means of this invention provides for a greater operating efficiency for an internal combustion engine.

It is obvious that the fuel atomizer means of this invention can be adapted to all types of internal combustion engines wherein a liquid fuel must be mixed in an airstream. This device results in substantially complete atomization of liquid fuel in an airflow thereby providing for greater operating efficiency thus eliminating or substantially reducing the need for auxiliary apparatus to be used with the engine for removing or reducing objectionable exhaust gas emissions such as carbon oxide, carbon dioxide, nitrogen oxide, etc.

As will become apparent from the foregoing description of a preferred embodiment of the Applicant's fuel atomizer a relatively simple and inexpensive means has been provided which is readily usable with existing carburetors in order to provide a novel and efficient means of substantially completely atomizing fuel thus promoting essentially complete combustion in the engine. The Applicant's fuel atomizer can be easily constructed to be used with single throat carburetor or multiple throat carburetors to provide for increased efficiency and fuel economy for same.

In the manufacture of the fuel atomizer structure of this invention it is obvious that it can be easily constructed to achieve the end product. The fuel atomizer is far less complicated than many of its prior art counterparts. The fuel atomizer can be easily constructed to be mounted with existing conventionally styled carburetors and it can also be constructed as a replacement part for such carburetors.

In the use and operation of the carburetor atomizer structure of this invention it is seen that same provides a novel fuel atomizer structure for a conventionally styled carburetor. The carburetor atomizer substantially completely atomizes the liquid fuel in a carburetor for an internal combustion engine which greatly increases the operating efficiency of the engine and reduces the amount of objectionable exhaust gas emissions.

As will become apparent from the foregoing description of the Applicant's carburetor atomizer structure, relatively inexpensive and simple means have been provided to assure the complete atomization of fuel in a carburetor for an internal combustion engine. The carburetor atomizer structure is economical to manufacture, simple to use and install and when installed significantly reduces the fuel consumption of an internal combustion engine.

While the invention has been described in conjunction with preferred specific embodiments thereof, it will be understood that this description is intended to illustrate and not to limit the scope of the invention, which is defined by the following claims.

I claim:

1. A carburetor for supplying an air-fuel mixture, comprising:

(a) a body having fuel-air mixture conduit therethrough, (b) said mixture conduit having an inlet on one end portion of said body an outlet on another end of said body, and a venturi portion between said inlet and said outlet, said carburetor being constructed and adapted to in use have air moving through said mixture conduit from said inlet through said venturi portion to said outlet, (c) a fuel reservoir within said body, (d) a throttle valve means in said mixture conduit selectively movable between a substantially closed position and a substantially fully open position to in use control fuel-air mixture flow through said mixture conduit, (e) a fuel atomizing means mounted within said body and having an atomizer tube extending into a center portion of said mixture conduit with the outlet of said atomizer tube in said center portion of said conduit, (f) said atomizer tube having a flared outlet end portion with the outlet end surface thereof extending transverse to said conduit, and with said outlet thereof opening toward said mixture conduit outlet, (g) a base secured to said body, said base including a feed tube vertically disposed therein, one end of said feed tube connected to said reservoir, the other end of said feed tube connected to said atomizing tube for supplying fuel thereto, said base further including an idle tube vertically disposed inside said feed tube, one end of said idle tube connected to said reservoir, the other end of said idle tube connected to an idle circuit in said carburetor for supplying fuel thereto, and (h) said base has a structure defining a cavity situated in the very most upper portion of said base, a plug is positioned on the upper end of said cavity, said atomizer tube flared outlet end portion is positioned in the low pressure zone of said venturi portion, said throttle means is downstream of said venturi portion, said atomizer tube has a substantially smooth interior to in use provide a substantially streamline flow, said atomizer tube extends into said conduit angularly toward said conduit outlet, said outlet end surface is substantially flat and essentially circular, said atomizer tube outlet has an outlet orifice centrally disposed relative to said outlet end surface, said carburetor has one inlet dividing into a plurality mixture conduits each having an outlet, and said carburetor has one of said fuel atomizing means in each of said plurality of mixture conduits, said carburetor is constructed and adapted to in use mix air and fuel in said mixture conduit with the atomizer tube flared outlet end portion creating a turbulance in the air flow in said mixture conduit to draw fuel through said atomizer tube and over said transverse outlet end surface for complete atomization of the fuel.

* * * * *